United States Patent [19]

Rahmstorf

[11] 3,995,395

[45] Dec. 7, 1976

[54] EASILY ASSEMBLABLE TOY FIGURE

[75] Inventor: Dietmar Rahmstorf, Nurnberg, Germany

[73] Assignee: Messrs. BIG Spielwarenfabrik Dipl.-Ing. Ernst A. Bettag, Furth, Bavaria, Germany

[22] Filed: Feb. 3, 1976

[21] Appl. No.: 654,903

[30] Foreign Application Priority Data

Feb. 18, 1975 Germany ..... 2506786

[52] U.S. Cl. ..... 46/161; 46/22; 46/164

[51] Int. Cl.[2] ..... A63H 3/00

[58] Field of Search ..... 46/161, 163, 164, 173, 46/151, 22

[56] References Cited

UNITED STATES PATENTS

| | | | |
|---|---|---|---|
| 2,475,306 | 7/1949 | Beder | 46/22 |
| 2,708,809 | 5/1955 | Peterson | 46/22 |
| 2,752,726 | 7/1956 | Calverley | 46/22 |
| 3,874,113 | 4/1975 | Beck | 46/161 |
| 3,946,517 | 3/1976 | Goldfarb et al. | 46/161 X |

FOREIGN PATENTS OR APPLICATIONS

| | | | |
|---|---|---|---|
| 621,083 | 4/1949 | United Kingdom | 46/22 |

*Primary Examiner*—F. Barry Shay

[57] ABSTRACT

The invention concerns an assemblable toy figure including: a head mounted on one end of a downwardly extending locking bar which has a flattened locking shoulder; and a hollow trunk divided into two havles and journalling arms and legs for pivotal movement about a horizontal axis. Each arm terminates in flange engageable in a lateral opening in the trunk and has extensions serving as pivotal axes. The legs engage in recesses at the front of the trunk for pivotal movement and are journalled by laterally projecting pins. For rapid, easy, and optionally mechanised, assembly and reliable locking, oblique surfaces are formed in one trunk half which resilient webs extend downwardly and towards each other with lower edges running perpendicularly to and overlapping the dividing plane. The lower edges of the oblique resilient webs cooperate with the shoulder of the locking bar for locking. Feet, hairpieces and other accessories may also be provided.

12 Claims, 4 Drawing Figures

EASILY ASSEMBLABLE TOY FIGURE

BACKGROUND OF THE INVENTION

1. Field of the Invention

The invention concerns an assemblable toy figure including a head rotatable about a downwardly extending vertical locking bar which has a shoulder flattened at its top and serving for locking; and a hollow trunk at which a pair of arms and a pair of legs are respectively pivotally journalled about an approximately horizontal axis. The upper end of each arm has an extending serving as a pivotal axis and terminates in a flange engageable in a respective lateral opening of the trunk. The legs engage from below in recesses at the front of the trunk enabling pivotal movement and are journalled by means of laterally projecting pins.

2. Description of the Prior Art

In a known toy figure of this general construction the trunk is constructed as a one-piece, hollow body open towards the bottom and receives a special journal element for locating the arms and legs. To assemble the known toy figure, the legs must first be secured to the bearing element. Then the arms with the extensions are inserted into the lateral openings of the trunks and then the bearing element with the legs is pushed from below into the trunk such that the forks provided at the upper end should engage the flanges on the extensions of the arms. Finally, by inserting the locking bar of the head the bearing element is secured against pulling out from the trunk. For locking, the locking pin has a shoulder which cooperates with internal projections of two prongs of the fork of the bearing element.

This known toy figure has many disadvantages. For one, because of the presence of the special bearing element inserted in the trunk, accurate fitting must be observed between the bearing element, the trunk and the limbs at a number of locations. However, considerably more serious is the fact that in the known toy figure appreciable difficulties arise in assembly. This is primarily to be traced back to the fact that until the bearing element is caught in the hollow trunk the arms must be held in the working position during assembly. Furthermore, it is necessary to have the bearing element with the legs already fixed thereto at hand in such a manner that the legs do not fall out during assembly. This risk exists in the known toy figure particularly because for fixing the legs the bearing element has two resiliently separatable limbs which at their upper ends carry forks for fixing the arms. If now during assembly these fork-carrying ends of the shanks are inadvertently pressed together, the legs fall out. Finally, it is also disadvantageous in the known toy figure that the locking pin provided under the head is not fully reliable. If a sufficiently larger force is used, the danger exists that the limbs carrying the detents or projections with which the shoulder of the locking pin cooperates are moved apart and the locking is then immediately released.

SUMMARY OF THE INVENTION

The task underlying the invention is to construct a toy figure of the above-mentioned type in such a manner that, on the one hand, it may be rapidly and easily assembled, (optionally by mechanised methods), and on the other hand, during manufacture accurate or precise matching of parts is required only at a few places and yet reliable locking is achieved. In addition the toy figure according to the invention should also be distinguished by a particularly high versatility in its freedoms of movement as well as by the fact that a plurality of accessories may be mounted easily yet, optionally, in an accurately aligned fashion.

To solve the above-mentioned task it is proposed according to the invention that the toy figure of the type described should be so constructed that the trunk is divided in known manner by a vertical transverse plane into two halves, the transverse plane passing through the openings for the extensions of the arms as well as through recesses at the inner wall of the trunk for receiving the bearing pin of the legs; that internally at each half at least one connecting web is provided which extends into the region of the other half; that all the connecting webs are provided with vertical bores which are aligned when the halves are assembled together, and through which the locking bar projects; and that on one of the trunk halves two oblique webs are formed which extend downwardly as well as towards each other and have approximately horizontal lower edges which may be moved apart somewhat, in a mutually parallel direction, the lower edges extending approximately perpendicularly to and overlapping the transverse plane to cooperate with the shoulder of the locking bar for locking. Expediently, each of the halves has two connecting webs, whereby two web pairs are formed each consisting of two inter-engaging webs from each trunk half.

In contrast to the known toy figure, in the toy figure according to the invention the arms and the legs are therefore not connected to a special bearing element, but instead are journalled directly at the trunk which for this purpose consists of two halves determined by a transverse plane passing through the openings for the arm extensions as well as the recesses for the bearing pins of the legs. This construction has the advantage that assembly is very simple. Namely, it is only necessary to set the arms with their extensions and the legs with the bearing pins into the recesses and slots associated therewith in one trunk half and finally to secure the two trunk halves by insertion of the locking pin carrying the head, whereby simultaneously the bar is locked by means of the lower edges of the oblique webs. Relatively precise matching in the figure according to the invention is required only in the region of the dividing surface between the two halves and, because of the vertical bores, at the connecting webs, which works out favourably also for example with regard to the properties of the plastics material conventionally used for the manufacture of such toy figures. The provision of the oblique webs and the use of the lower edges thereof for the detent or catching engagement of the locking bar has the advantage that in attempting to pull out the locking bar the pressure exerted by the shoulder on the edges does not separate the oblique webs but rather presses them more strongly towards each other which counteracts an inadvertent release.

It is particularly advantageous to connect the oblique webs at the top directly to the openings for the arms and to provide each of the flanges of the arms with a plurality of peripheral flats determining a plurality of different arm positions against which the associated oblique web lies. In order to achieve in this case a particularly good cooperation between the flats of the flanges and the oblique webs, the latter may expediently be provided at their upper end with approximately horizontal levelling-off as locating surface for the flats of the flanges of the corresponding arm. This construction has the advantage that each time a flat lies adjacently at the upper end of the oblique web a stabilized arm position results. Consequently the arms can be so constructed that they can be retained in a plurality of angular positions corresponding to the most frequently occurring natural arm positions, e.g. in a position where the arms hang downwardly, in an approximately horizontal arm position as well as in a position in which the arms extend upwardly next to the head.

It may be advantageous to provide the bottom of one of the trunk halves with a resilient extension to lie against flats at the upper ends of the legs, wherein expediently the extension is provided at the front trunk half to cover over a cut-out or recess. When such a resilient extension is present for cooperating with flats of the legs, then the legs also may be detained in different positions, particularly for a "standing" or "sitting" figure.

The manufacture of the toy figure is made particularly simple when the trunk halves are formed of a single piece with the connecting webs, the oblique webs and optionally the resilient extension, expediently from plastics material.

Further, it is possible to provide one leg with an axle forming the bearing pin on which the other leg provided with a horizontal journal opening is mounted for independent pivotal movement. The presence of two independently pivotable legs affords the possibility to place the toy figure into a plurality of positions corresponding to a model.

The number of positions that the toy figure is capable of assuming may be increased still further by terminating the bottoms of the legs in approximately spherical elements which are snapped into approximately vertical downwardly flaring bores in the leg parts. In this embodiment the feet may be brought into different positions relative to the legs and thereby a stable standing position of the figure can be ensured for different leg positions.

Finally the possibility arises of providing the head with a vertical slot into which a downward projection of a hair piece is insertable, wherein the recess and the projection have complementary non-circular cross-sections. Further, it is advantageous to provide the projection of the hair part with an axial aperture because in that latter case further additional parts may be placed on the hair part. By using different per se known hair pieces various aspects can be achieved from a basic toy figure, while further variations possibilities may be provided by adding different clothing pieces and other accessories.

BRIEF DESCRIPTION OF THE DRAWINGS

A preferred embodiment of a toy figure according to the invention will now be described with reference to the drawings.

DESCRIPTION OF THE PREFERRED EMBODIMENT

Figure 1:
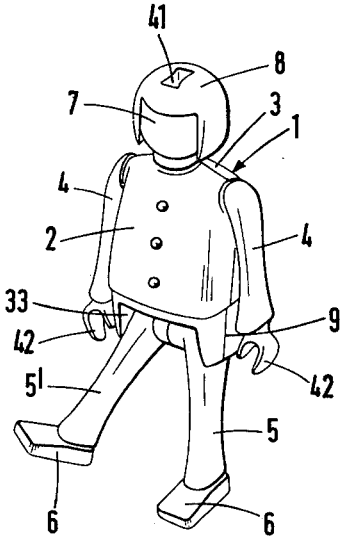
FIG. 1 shows the toy figure in perspective.

From FIG. 1 it can be seen that the toy figure according to the invention consists of a trunk 1 made of two half-trunk portions, also referred to simply as halves 2 and 3, two arms 4, tow legs 5, two foot parts 6 as well as a head 7 with a hair piece 8. The front half 2 and the rear half 3 of the trunk 1 are formed by a division of the trunk along a transverse plane 9 passing through the pivotal points or axes of the arms 4 and legs 5.

Figure 2:
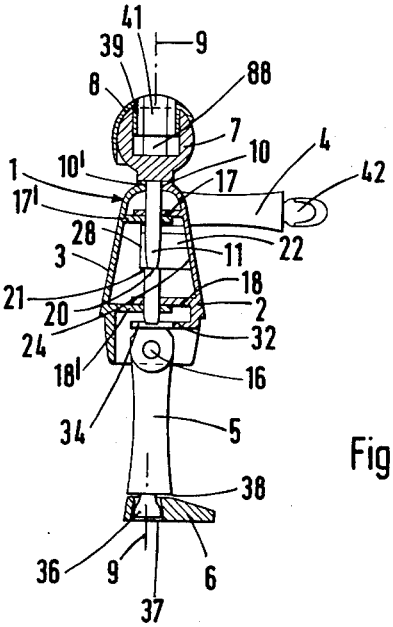
FIG. 2 shows a vertical section of the figure taken along a plane perpendicular to the transverse plane which separates the two halves of the figure through the trunk as well as a leg part.
Figure 3:
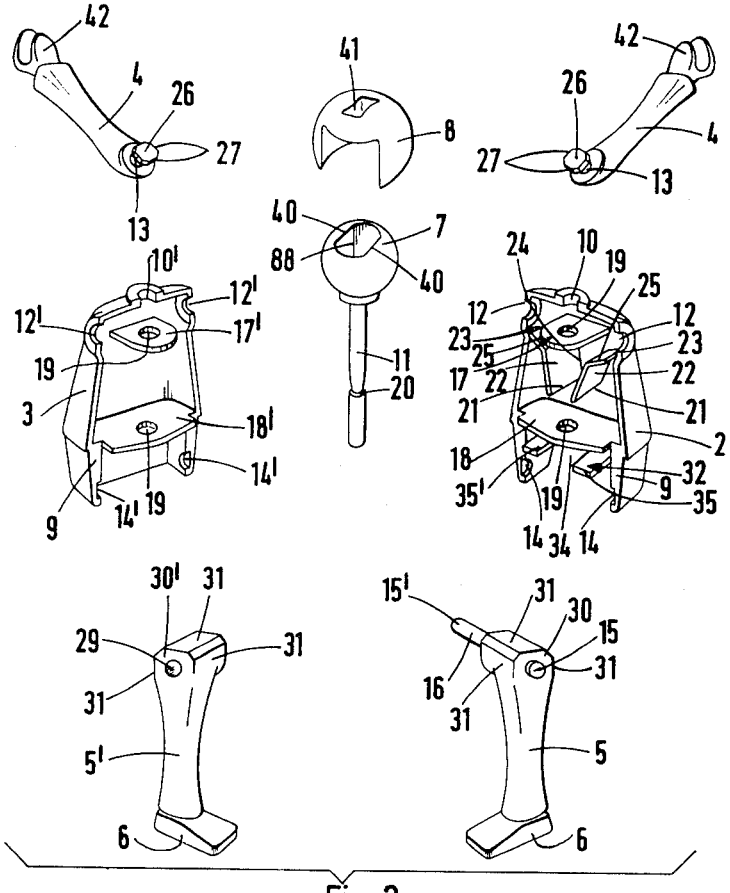
FIG. 3 is an exploded view of FIG. 1.

The arrangement and the cooperation of the individual components may best be understood by reference to the vertical section of FIG. 2 and the exploded view of FIG. 3.

The front trunk half 2 and the rear trunk half 3 correspond with each other insofar as at their upper side there are provided respective semi-circular recesses 10, 10' starting from the transverse plane 9. When the two halves 2 and 3 are put together there results a through-going opening for a locking bar 11 formed at the bottom of the head 7.

Further, the two halves, 2, 3 have at their upper sides a pair semi-circular recesses 12, 12' respectively, which form through-going openings for extensions 13 on the arms 4 serving as pivotal axes when the two halves 2, 3 abut each other. Finally the halves 2, 3 are provided at the bottom with respective pairs of recesses 14, 14' which are semi-circular in plan and which in use receive the ends 15, 15' of a bearing spindle or pin 16 serving to journal the two legs. The recesses 10 and 10'; the openings 12—12 and 12'—12'; and the recesses 14—14, 14'—14' are respectively of the same size in the illustrated embodiment, which means that the transverse plane 9 runs through the respective pivotal aces or rotational axes of the parts 4, 5 and 7 in the finished figure.

Further, the two halves 2, 3 are each provided with two internal connecting webs 17, 18 and 17', 18' which are arranged approximately horizontally and extend on assembly into the other trunk half, respectively. The upper connecting webs 17, 17' are relatively narrow while the lower connecting webs 18, 18' extend transversely across the whole of the interior of the associated trunk half. FIG. 2 clearly shows that in the assembled toy figure the upper connection webs 17 17' of the halves, 2, 3 and the lower connecting webs 18, 18' of the same halves lie against and on top of each other to form two web pairs 17, 17' and 18, 18'. Each connecting web 17, 17' 18, 18' is provided with a vertical bore 19 the axis of which lies in the transverse plane 9. Thus when the two halves 2, 3 are laid against each other and subsequently the locking bar 11 is inserted through the opening 10, 10' the bar will project through all the mutually aligned bores 19 of the connecting webs 17, 17' 18 and 18', (FIG. 2).

In order to make it practically impossible for a playing child to dismantle the assembled toy figure, a locking arrangement is provided for the locking bar 11. For this purpose approximately centrally between the web pairs 17, 17', 18, 18' the bar 11 has a shoulder 20 forming an upwardly facing circumferential bearing surface. The front trunk half 2 is formed with two internal webs 22 hereafter referred to for convenience as "oblique webs", see FIG. 3, because they project downwardly and inwardly. In the use position, as shown in FIG. 2, the lower edges 21 of the two oblique webs 22 cooperate with this shoulder 20. Further, the construction of the oblique webs 22 is such that their lower edges 21 may be moved apart from each other somewhat when the locking bar 11 is pushed in. However, once the locking bar 11 finds itself in the locked position according to FIG. 2, its release by pulling the head 7 upwardly is practically impossible. This is because such a force on the locking bar 11 causes the lower edges 21 of the oblique webs 22 to move even more strongly towards each other and consequently the force with which they bear against the locking bar 11 in the region of the shoulder 20 is increased.

From FIG. 3 it can be seen that at the front trunk half 2 the upper edges 23 of the oblique webs 22 are arranged directly to adjoin the openings 12, 12' for the extensions 13 of the arms 4. The construction is, however, such that the edges 23 are not connected with the side surfaces of the front trunk half 2. Rather, the oblique webs 22 are secured to the trunk half 2 only along their front edges 24 (FIG. 2). From this it follows that the upper edges 23 of the oblique webs 22 can move somewhat vertically because of the elasticity of the material. In order to improve this displaceability in a vertical direction, the edges 23 are provided on an approximately horizontal bent portion 25.

Figure 4:
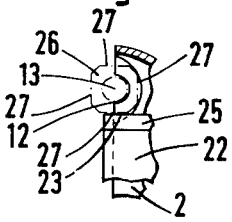
FIG. 4 is partially in section showing a detail of the front trunk half to illustrate the detention of the arm in different positions.

The displaceability of the edges 23 of the bent portions 25 of the oblique webs 22 in the toy figure according to the invention is utilized to enable the arms 4 be stayed in a variety of positions, for instances, in the downwardly hanging position of the arms according to FIG. 1 or in the horizontal position in FIG. 2. To this end, the extensions 13 for journalling the arms 4 terminate in flanges or lugs 26 each provided with a plurality of flats 27 distributed over its periphery, as can be seen particularly clearly from FIG. 4. These flats 27 cooperate with the upper edges 23 of the bent portions 25 of the oblique webs 22. By rotating the arms the edges 23 will be somewhat displaced. These arms then snap automatically into position in which respectively, one of the flats 27 bears against the associated edge 23.

With regard to the oblique webs 22 it is finally still to be noted that, as already mentioned, they are fixed only along their front edges 24 to the trunk half 2. Their length is so chosen that their rear edges 28 project beyond the transverse plane 9 in order reliably to encompass the shoulder 20 of the locking bar 11 which lies with its longitudinal axis in the transverse plane 9.

FIGS. 1 and 3 show that in the toy figure according to the invention both legs 5 are separately pivotable. To this end the leg 5' shown at the left in FIG. 3 is provided with a horizontal journalling bore 29 by means of which the leg 5' can be pushed onto the bearing pin 16 of the other leg 5 in such a manner that the left end 15' of the bearing pin 16 somewhat projects over the end surface 30' of the leg 5', as is the case also at the other end 15 of the bearing pin 16 relative to the surface 30 of the leg 5. The projecting ends 15 and 15' of the bearing pin 16 then rest in the two recesses formed by the recess pairs 14, 14' of the trunk halves 2, 3.

In order to provide for the detent of the legs 5, 5' in different positions also, they too are provided at their upper ends with flats 31, and more precisely at the top, at the front and at the rear. a resilient extension 32 cooperates with these flats 31 of the legs 5, 5' which extension is formed at the bottom of the front trunk half 2 and covers at the top cut-out 33 (FIG. 1) of the front trunk half 2 enabling pivotal movement of the legs 5, 5'. This extension 32 is provided with an opening or break 34 in the middle so that two separate prongs 35, 35' result, each acting respectively on one of the legs 5, 5'.

At the bottom, as can be seen from FIG. 2, the legs end in an at least partly spherical part 36. This part 36 is snap-fitted into a bore 37 of the foot part 6 which narrows upwardly, i.e. towards the lower edge 38 of the legs 5, 5'. This ball-joint type connection between the legs, 5, 5' and the foot parts 6 provides the facility of affording a secure footing for the toy figure in a plurality of different positions. For example, as shown in FIG. 1, the toy figure may be stood up even with just one leg on a supporting surface, as shown in FIG. 1.

Naturally the feet 6 may be rotated about the longitudinal axes of the legs 5, 5'. Since in addition the head 7 may also be rotated by 180° without any difficulty, the toy figure according to the invention may in given cases be brought into a somewhat kneeling position. To this end the legs 5, 5' are pivoted to the upper end position which is normally the sitting position. Then the head is rotated "rearwardly" and the foot parts 6 are also turned rearwardly. This procedure is not possible, of course, if the foot parts 6 are rigidly connected with the legs 5, 5'.

Finally, it may also be seen from the drawings that the head 7 has a vertical slot 88 into which a downward projection 39 of a hair piece 8 is insertable to secure the hair piece 8 to the head 7 (FIG. 2). Both the vertical slot 88 and the projection 39 of the hair piece 8 have cross-sections differing from the circular. In the illustrated example, the slot 88 is flattened at two opposite sides 40 (FIG. 3). Correspondingly, naturally, the projection 39 of the hair piece 8 is similarly flattened. In order to enable a hat or other part to be placed on the head of the toy figure, notwithstanding the presence of the hair piece 8, the projection 39 of the hair piece 8 is provided with an axial hole 41, which is equally non-circular in cross-section, in order reliably to prevent the hat or the like to be rotated. If the figure carries no hat or another part on the hair piece 8, the hole 41 is closed by means of a non-illustrated stopper.

The assembly of the toy figure according to the invention takes place simply by assembling first the two legs, 5, 5' by means of the bearing pin 16 and the bore 29. Then, the two legs with the ends 15, 15' of the pin 16 are laid or engaged in the recesses 14, 14' in one of the halves 2 or 3 of the trunk 1 and also the arms 4 with the extensions 13 serving as pivotal axes are inserted into the semi-circular grooves 12, 12' serving as openings for the arms. As soon as this has taken place, the other half 3 or 2 of the trunk 1 is mounted. Then the locking bar 11 located on the head 7 is introduced through the opening 10, 10' axially into the assembled trunk 1 so that the bar 11 extends through all the vertical bores 19 of all the webs 17, 17', 18, 18'. As soon as the locking bar 11 is fully inserted, the lower edges 21 of the oblique webs 22 snap in or catch at the shoulder 20 of the locking bar 11 so that the latter is secured against release. It is then merely necessary to secure the feet 6 by snapping-in the part-spherical members 36 of the legs 5, 5' into the bores 37 and to place on the head 7 the hair piece 8, and in given cases a hair covering (hat) or the like.

I claim as my invention:

1. An assemblable toy figure, comprising a head, a generally downwardly projecting vertical locking bar secured to said head and rotatable therewith, an upwardly flattened shoulder on said bar to serve for locking purposes, a hollow trunk, a pair of arms and a pair of legs respectively adapted to be mounted in the trunk for pivoting about a generally horizontal axis, an upper end on each arm terminating in a flange, lateral openings defined in the trunk for receiving said flanges, extensions on said flanges serving as pivotal axes, the legs being engageable from below into the front of the trunk, a notch defined in the front of the trunk for enabling pivotal leg movement, laterally projecting pins for journalling the legs within the trunk, wherein the improvements consists in that the trunk is divided along a vertical transverse axis into two trunk halves, the transverse plane extending through the said lateral openings for the arm extensions and through recesses in the said trunk for receiving the said pins of the legs, the inside of each trunk half being provided with at least one connecting web, each web extending into the other trunk half in the assembled condition, and a vertical bore defined in each web, the bores being aligned when the trunk halves are assembled together for permitting the locking bar to project through all the bores, and wherein two oblique resilient webs are formed at one of the trunk halves and extend downwardly as well as towards each other, terminating in generally horizontal lower edges that have limited freedom to move apart in parallel, the edges overlapping the transverse plane perpendicularly to the latter and serving to cooperate and engage with the shoulder of the locking bar for locking.

2. A toy figure according to claim 1 wherein each of the halves has two of said connecting webs so that on assembly two web pairs are formed comprising respectively the abutting webs of the two trunk halves.

3. A toy figure according to claim 1 wherein the oblique resilient webs are directly connected to said one trunk half and extend adjacent to the openings for the arms, a plurality of peripheral flats being provided on the flanges of the arms to define different arm positions, the associated oblique resilient web bearing against these flats.

4. A toy figure according to claim 3 wherein the upper end of each oblique resilient web terminates in a generally horizontally bent surface portion serving as a bearing surface for the flats of the associated flange of the corresponding arm.

5. A toy figure according to claim 1 wherein at the botom of one of the trunk halves a resilient extension is provided and flats are formed at the upper end of each leg engagingly to cooperate with said extension.

6. A toy figure according to claim 5 wherein the extension is provided at the front trunk half to overlie said notch for enabling pivotal leg movement.

7. A toy figure according to claim 1 where the trunk halves are of one piece with the respective associated connecting webs and said one trunk half is of one piece with the said oblique resilient webs.

8. A toy figure according to claim 5 wherein said resilient extension is integral with its associated trunk half.

9. A toy figure according to claim 1 wherein an axle is provided on one leg to form the journalling pins a horizontal bearing hole defined in the other leg being adapted to receive a said journalling pin so as to journal said other leg for pivotal movement independently of said one leg.

10. A toy figure according to claim 1 wherein foot parts are provided with bores defined therein, the legs terminating in elements capable of forming a ball joint when snapped into said bores defined in said foot parts, the bores flaring in a downward direction.

11. A toy figure according to claim 1 wherein a vertical slot is defined in the head; and there is provided a hairpiece, a projection at the bottom of the hairpiece insertable into said slot, the slot and the projection having complementary non-circular cross-sections.

12. A toy figure according to claim 11 wherein an axial aperture is defined in the projection of the hairpiece for the attachment of other accessories.

* * * * *